US010569979B2

(12) United States Patent
Ito

(10) Patent No.: US 10,569,979 B2
(45) Date of Patent: Feb. 25, 2020

(54) SHEET FEEDING APPARATUS

(71) Applicant: CANON FINETECH NISCA INC., Misato-shi (JP)

(72) Inventor: Shoji Ito, Soka (JP)

(73) Assignee: Canon Finetech Nisca Inc., Misato-shi (JP)

( * ) Notice: Subject to any disclaimer, the term of this patent is extended or adjusted under 35 U.S.C. 154(b) by 0 days.

(21) Appl. No.: 16/223,787

(22) Filed: Dec. 18, 2018

(65) Prior Publication Data

US 2019/0193963 A1 Jun. 27, 2019

(30) Foreign Application Priority Data

Dec. 26, 2017 (JP) ..... 2017-250028
Dec. 13, 2018 (JP) ..... 2018-233639

(51) Int. Cl.
*B65H 1/26* (2006.01)
*B65H 1/12* (2006.01)
*B65H 1/04* (2006.01)

(52) U.S. Cl.
CPC ..... *B65H 1/266* (2013.01); *B65H 1/04* (2013.01); *B65H 1/12* (2013.01); *B65H 1/26* (2013.01); *B65H 2402/543* (2013.01); *B65H 2405/121* (2013.01); *B65H 2405/15* (2013.01); *B65H 2801/06* (2013.01)

(58) Field of Classification Search
CPC ... B65H 1/00; B65H 1/04; B65H 1/26; B65H 1/266; B65H 2402/32; B65H 2405/12; B65H 2405/121; B65H 2405/15; B65H 2405/31; B65H 2405/32
See application file for complete search history.

(56) References Cited

U.S. PATENT DOCUMENTS 9,310,752 B2 4/2016 Hiura et al.
2008/0117482 A1* 5/2008 Kusumi ..... B65H 5/38 358/498

(Continued)

FOREIGN PATENT DOCUMENTS

JP 2006151687 A * 6/2006 ..... G03G 15/6502
JP 2011-197355 A 10/2011

(Continued)

OTHER PUBLICATIONS

Office Action dated Nov. 29, 2019, in Japanese Patent Application No. 2018-233639.

*Primary Examiner* — Prasad V Gokhale
(74) *Attorney, Agent, or Firm* — Venable LLP

(57) ABSTRACT

There is provided with a sheet feeding apparatus. A biasing unit generates a biasing force of biasing a storage unit in an insertion direction. A repulsive unit generates a repulsive force of biasing the storage unit in a direction opposite to the insertion direction. A fixing unit fixes the storage unit in a fixing position. The biasing unit starts generating the biasing force in a repulsion start position where the repulsive unit starts generating the repulsive force, or on an upstream side of the repulsion start position, in the insertion direction, and stops generating the biasing force before the storage unit reaches the fixing position. A biasing Zone in which the biasing unit generates the biasing force and a repulsive zone in which the repulsive unit generates the repulsive force partially overlap each other.

8 Claims, 10 Drawing Sheets

(56) References Cited

U.S. PATENT DOCUMENTS

| | | | | |
|---|---|---|---|---|
| 2013/0032996 | A1* | 2/2013 | Kubota | B65H 1/266 271/264 |
| 2013/0285317 | A1* | 10/2013 | Ishikura | B65H 9/08 271/241 |
| 2016/0137444 | A1* | 5/2016 | Kasaishi | B65H 5/36 271/9.09 |

FOREIGN PATENT DOCUMENTS

| | | | |
|---|---|---|---|
| JP | 2012-101888 | A | 5/2012 |
| JP | 2013-256355 | A | 12/2013 |
| JP | 2016-005989 | A | 1/2016 |
| JP | 2016-124699 | A | 7/2016 |

* cited by examiner

SHEET FEEDING APPARATUS

BACKGROUND OF THE INVENTION

Field of the Invention

The present invention relates to a sheet feeding apparatus.

Description of the Related Art

Conventionally, an image forming apparatus such as a copying machine or printer including a sheet storage unit which can be pulled out and in which sheets are stacked and stored is known. A sheet storage unit like this sometimes includes a rail-type retracting mechanism which biases the sheet storage unit in a closing direction, in order to reduce an operation power required for the user to close the sheet storage unit. Japanese Patent Laid-Open No. 2016-5989 discloses an arrangement in which when the user closes a sheet storage unit to a predetermined position in a storage apparatus including the rail-type retracting mechanism, a biasing force acts in a direction to close the sheet storage unit, thereby retracting the sheet storage unit to a locking position.

On the other hand, as a storage apparatus connected to an image forming apparatus and including a sheet storage unit and a housing, a storage apparatus including a large-capacity sheet storage unit in which a few thousands of sheets can be replenished is recently increasing in number. In addition, as the needs for performing printing on elongated sheet longer than regular-sized sheet are increasing on the printing market, a storage apparatus capable of storing elongated sheet is also increasing in number.

When the storage apparatus includes the rail-type retracting mechanism, the storage apparatus retracts a sheet storage unit by the biasing force of a spring after a predetermined position. This makes it possible to reduce the power necessary for the user to perform an operation. However, to buffer an impact caused by a collision when closing the sheet storage unit, the storage apparatus sometimes includes a side regulating member support mechanism which generates a repulsive force. In this case, it is necessary to retract the sheet storage unit by a biasing force larger than the repulsive force of the side regulating member support mechanism. In particular, an elongated-sheet storage apparatus requires a biasing force larger than that of a regular-sized-sheet storage apparatus.

In the arrangement of Japanese Patent Laid-Open No. 2016-5989, the biasing force of the spring is acting even when the sheet storage unit is retracted to the end and collides against the housing. Therefore, when the biasing force is large like that of an elongated-sheet storage apparatus, the biasing force and the force of closing the sheet storage unit by the user may together apply a large load on a member such as a mechanical stopper. A load like this may damage the storage apparatus or decrease the durability.

SUMMARY OF THE INVENTION

According to one embodiment of the present invention, a sheet feeding apparatus for feeding a sheet to an image forming apparatus comprises a housing; a storage unit which is accommodated inside the housing, includes a sheet stacking unit capable of stacking a plurality of the sheets, and is movable in an insertion direction with respect to the housing; a biasing unit configured to generate a biasing force of biasing the storage unit in the insertion direction, when the storage unit moves in the insertion direction; a repulsive unit configured to generate a repulsive force of biasing the storage unit in a direction opposite to the insertion direction; a fixing unit configured to fix the storage unit in a fixing position inside the housing, in a state in which the storage unit is receiving the repulsive force from the repulsive unit; and a feeding unit configured to feed the sheets stacked in the sheet stacking unit to the image forming apparatus, wherein the biasing unit starts generating the biasing force in a repulsion start position where the repulsive unit starts generating the repulsive force, or on an upstream side of the repulsion start position, in the insertion direction, and stops generating the biasing force before the storage unit reaches the fixing position, and a biasing zone in which the biasing unit generates the biasing force and a repulsive zone in which the repulsive unit generates the repulsive force partially overlap each other in the insertion direction.

An embodiment of the present invention can prevent an increase in load to be applied on an apparatus by a user's operation of closing a sheet storage unit.

Further features of the present invention will become apparent from the following description of exemplary embodiments (with reference to the attached drawings).

DESCRIPTION OF THE EMBODIMENTS

Figure 1:
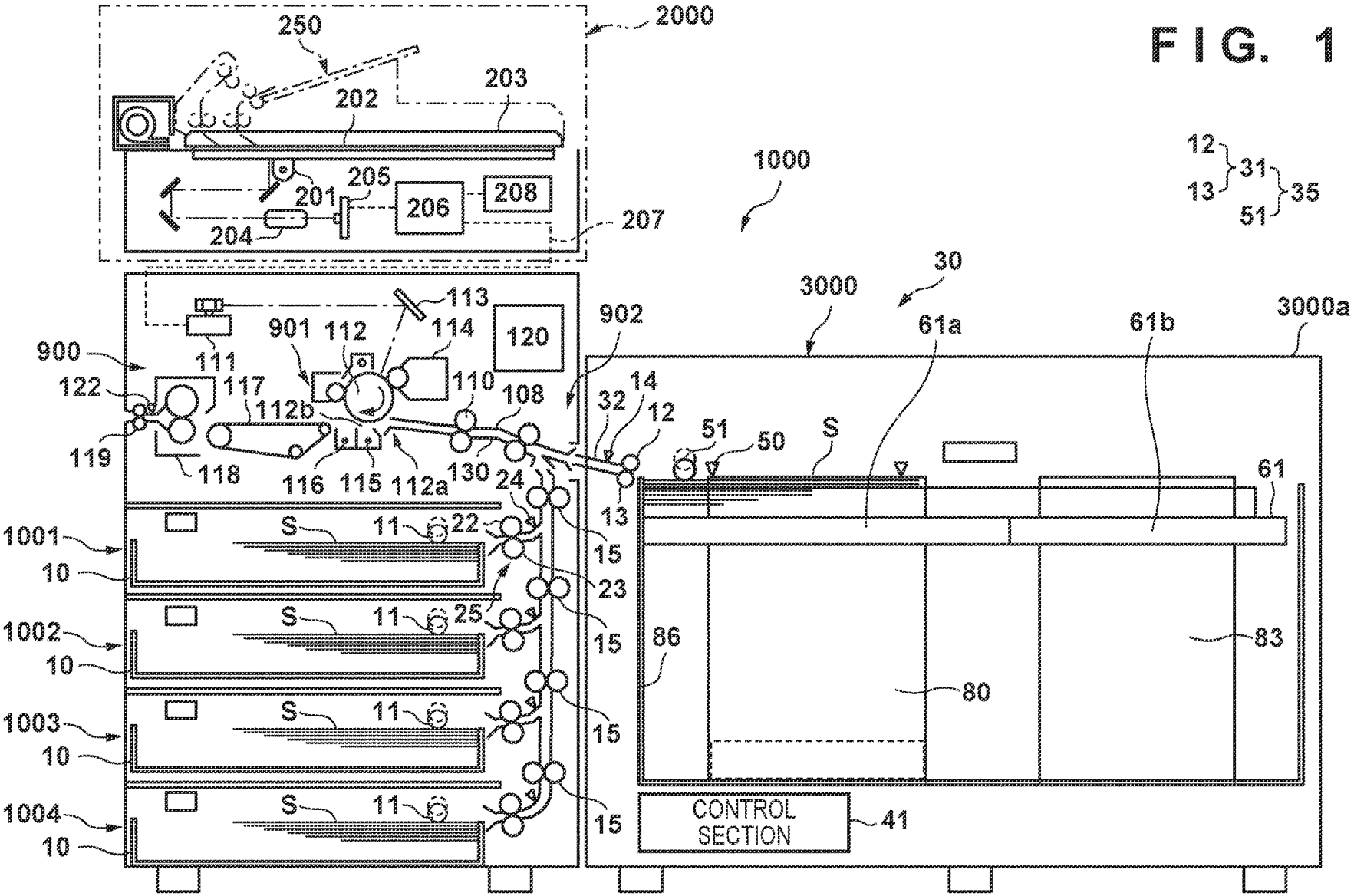
FIG. 1 is a view showing the arrangement of an image forming apparatus.

Preferred embodiments of the present invention will now be described hereinafter in detail, with reference to the accompanying drawings. It is to be understood that the following embodiments are not intended to limit the claims of the present invention, and that not all of the combinations of the aspects that are described according to the following embodiments are necessarily required with respect to the means to solve the problems according to the present invention. Note that the same reference numerals denote the same constituent elements, and an explanation thereof will be omitted.

<Outline of Arrangement of Imaging Forming Apparatus>

FIG. 1 is a schematic sectional view showing an image forming apparatus (image forming system) including a sheet feeding apparatus according to this embodiment. An image forming apparatus 1000 includes an image forming apparatus main body (to be referred to as an apparatus main body hereinafter) 900, a scanner apparatus 2000 arranged on the upper surface of the apparatus main body 900, and a paper deck 3000 connected to the apparatus main body 900.

The scanner apparatus 2000 includes a scanning optical system light source 201, a platen glass 202, an openable/closable document press plate 203, a lens 204, a light-receiving element (photoelectric conversion element) 205, an image processor 206, and a memory unit 208, and can optically read a document. The scanner apparatus 2000 reads an image of a document (not shown) placed on the platen glass 202, with the document surface facing down and the back surface being pressed by the document press plate 203, by irradiating the document with light from the scanning optical system light source 201. The read document image is processed by the image processor 206, converted into an electrical signal 207 which is electrically encoded, and transmitted to a laser scanner 111 in the apparatus main body 900. Note that the image processor 206 can also temporarily store the encoded image information in the memory unit 208, and transmit the image information to the laser scanner 111 as needed in accordance with a signal from a controller 120 (to be described later).

Note also that the paper deck 3000 includes a control unit 41 which controls the paper deck 3000 in accordance with a command from the controller 120. The control unit 41 includes a CPU, a RAM, and a ROM, and comprehensively controls the paper deck 3000.

The apparatus main body 900 includes sheet feeding cassettes 1001, 1002, 1003, and 1004 for feeding sheets S, and a sheet conveying apparatus 902 for conveying the sheets S fed from the sheet feeding cassettes 1001 to 1004 to an image forming unit 901. The apparatus main body 900 includes the controller 120. The controller 120 includes a CPU, a RAM, and a ROM, and comprehensively controls the individual units of the image forming apparatus 1000. The cooperation of the controller 120 in the apparatus main body 900 and the control unit 41 in the paper deck 3000 implements the overall operation of the image forming apparatus 1000.

Each of the sheet feeding cassettes 1001 to 1004 includes a storage unit 10 for storing the sheets S, a pickup roller 11, and a separation conveyor roller pair 25 including a feed roller 22 and a retard roller 23. The sheets S stored in the storage unit 10 are separately fed one by one by the pickup roller 11 which performs a vertical moving operation and rotates at a predetermined timing, and the separation conveyor roller pair 25. In addition, a feed sensor 24 is arranged near the downstream side of the feed roller 22 and the retard roller 23 in the sheet feeding direction. The feed sensor 24 detects the passing of the sheet S, and transmits a sensing signal to the controller 120.

The sheet conveying apparatus 902 includes a conveyor roller pair 15, a pre-registration roller pair 130, and a registration roller pair 110. The sheet S fed from the sheet feeding cassettes 1001 to 1004 is passed through a sheet conveyance path 108 by the conveyor roller pair 15 and the pre-registration roller pair 130, and guided to the registration roller pair 110. After that, the registration roller pair 110 supplies the sheet S to the image forming unit 901 at a predetermined timing.

The image forming unit 901 includes a photosensitive drum 112, the laser scanner 111, a developing device 114, a transfer charging device 115, and a separation charging device 116. In image formation, a mirror 113 reflects a laser beam from the laser scanner 111, and the photosensitive drum 112 rotating clockwise is irradiated with the laser beam, thereby forming an electrostatic latent image on the photosensitive drum 112. Then, the electrostatic latent image formed on the photosensitive drum 112 is developed as a toner image by the developing device 114. This toner image on the photosensitive drum 112 is transferred onto the sheet S by the transfer charging device 115 in a transfer unit **112*b*. A sensor 112*a* senses a sheet before the transfer charging device 115. Furthermore, the sheet S onto which the toner image is thus transferred is electrostatically separated from the photosensitive drum 112 by the separation charging device 116, conveyed by a conveyor belt 117 to a fixing apparatus 118 where the toner image is fixed, and discharged by discharge rollers 119. Note that the image forming unit 901 and fixing apparatus 118 form an image on the sheet S fed from a sheet feeding apparatus 30 or the sheet feeding cassettes 1001 to 1004**.

In addition, a discharge sensor 122 is arranged in a conveyance path between the fixing apparatus 118 and the discharge rollers 119. The controller 120 detects the passing of the discharged sheet S based on a sensing signal from the discharge sensor 122.

Note that the apparatus main body 900 and the scanner apparatus 2000 are formed as discrete units in this embodiment, but the apparatus main body 900 and the scanner apparatus 2000 may also be integrated. Note also that regardless of whether the apparatus main body 900 is separated from or integrated with the scanner apparatus 2000, the apparatus main body 900 functions as a copying machine when a processing signal of the scanner apparatus 2000 is input to the laser scanner 111, and functions as a FAX apparatus when a FAX transmission signal is input to the laser scanner 111. Furthermore, the apparatus main body 900 functions as a printer when a signal from a personal computer (PC) is input to the laser scanner 111. Also, when a processing signal of the image processing unit 206 of the scanner apparatus 2000 is transmitted to another FAX apparatus, the scanner apparatus 2000 functions as a FAX apparatus. In addition, if an automatic document feeder (ADF) 250 as indicated by the alternate long and two short dashed lines is used instead of the document press plate 203 in the scanner apparatus 2000, the scanner apparatus 2000 can read a plurality of documents (not shown) in succession.

<Outline of Arrangement of Large-Capacity Deck>

Figure 2A:
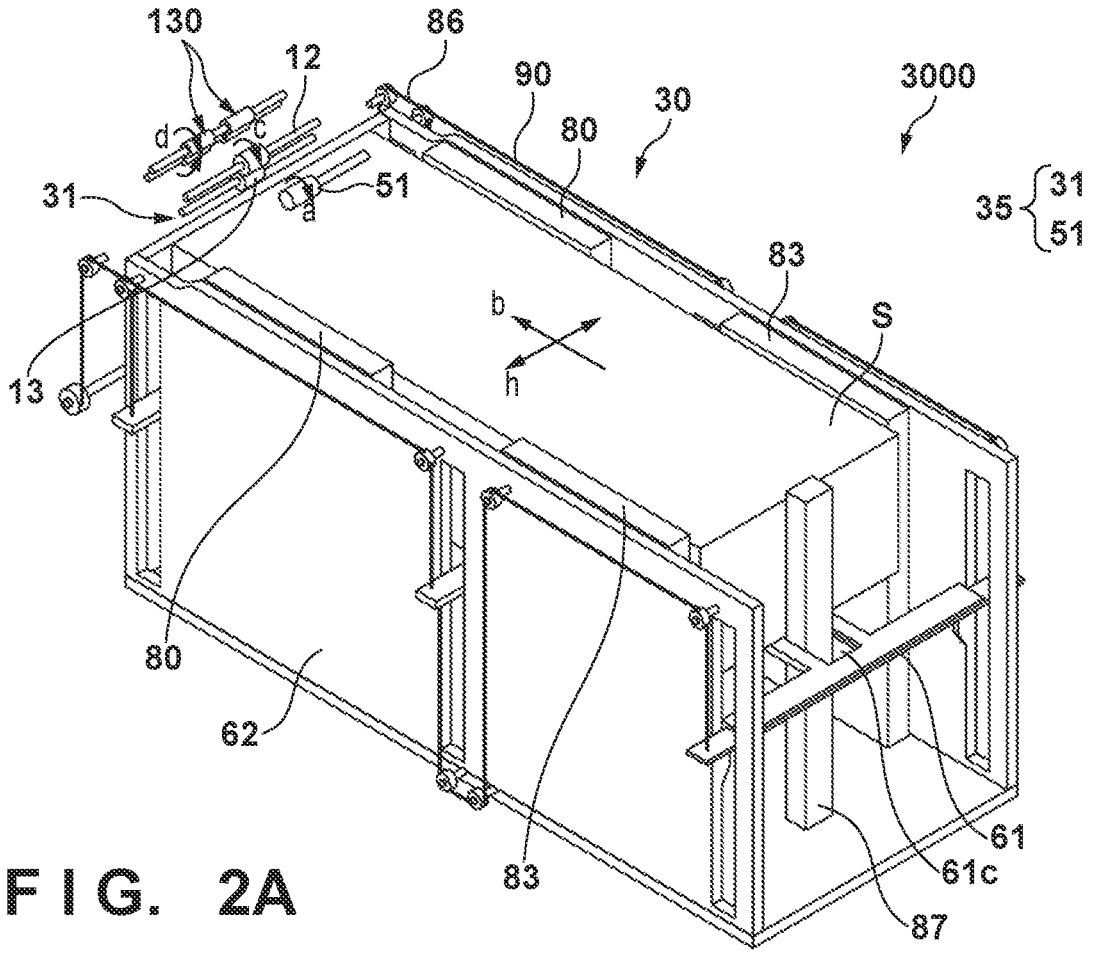
FIG. 2A is a view showing the arrangement of a paper deck, and showing a state in which a rear-end regulating member is moved and elongated-sheets are stacked.

Next, the sheet feeding apparatus 30 of the image forming apparatus 1000 according to this embodiment will be explained by taking the paper deck 3000 as a large-capacity deck as an example. FIG. 2A is a perspective view showing the arrangement of main parts of the paper deck 3000 with an exterior cover being removed.

As shown in FIGS. 1 and 2A, the paper deck 3000 as the sheet feeding apparatus 30 includes an apparatus main body 3000*a* (a housing), and a large-capacity deck storage 62 (a storage unit) accommodated in the apparatus main body 3000*a* (the housing). When the user performs a sliding operation, the large-capacity deck storage 62 can be pulled out in a direction (the direction of an arrow h in FIG. 2A) perpendicular to the sheet feeding direction. Also, the large-capacity deck storage 62 includes two pairs of side regulating members 80 and 83 for stacking and conveying the sheets S parallel to the sheet feeding direction, and a side regulating member support mechanism 90 (a repulsive unit) which suppresses bending and deformation of the side regulating members 80 and 83 on the back side.

The sheet feeding apparatus 30 also includes a main lifter (main tray) 61*a* and an extension lifter (extension tray) 61*b* (to be generally referred to as a lifter 61 (a sheet stacker) in some cases hereinafter), a pickup roller 51, and a separation conveyor roller pair 31. The separation conveyor roller pair 31 includes a feed roller 12 and a retard roller 13. The pickup roller 51 and the separation conveyance roller pair 31 form a feeding unit 35 which feeds the sheets S stacked and stored in the large-capacity deck storage 62 to the imaging forming unit 901 as a feeding destination.

The main lifter 61*a* is used to stack sheets SS of regular-sized (for example, regular-sized sheet such as A3 or A4). The extension lifter 61*b* extends the stacking region on the main tray and is used to feed sheets SL of large-sized (for example, elongated sheet to be used as a book cover, facing pages of a catalogue, or POP advertisement). That is, the lifter 61 makes it possible to stack sheets from regular-sized sheets to large-sized sheets. The lifter 61 is supported by a driving mechanism including an elevation motor (not shown) so as to be vertically movable in the stacking direction.

The pickup roller 51 is installed near the end portion of the side where the sheet feeding apparatus 30 is connected to the apparatus main body 900 above the lifter 61 and in the sheet feeding direction (the direction of an arrow b in FIG. 2A). In this embodiment, when an appropriate force is applied to the uppermost sheet S on the lifter 61, the pickup roller 51 can be urged against the sheet S. The sheet S on the lifter 61 is fed to the separation conveyor roller pair 31 by being urged against the pickup roller 51 rotating in the feeding direction (the direction of an arrow a in FIG. 2A) of the sheet S. The pickup roller 51 feeds the sheets S to the separation conveyor roller pair 31 at predetermined timings by repeating the vertical motion at predetermined timings.

The separation conveyor roller pair 31 is arranged on the downstream side of the pickup roller 51, and includes the feed roller 12 and the retard roller 13. The feed roller 12 rotates in the same direction (the direction of an arrow c in FIG. 2A) as the arrow-a direction in FIG. 2A, and feeds the sheet S, which is fed to the separation conveyor roller pair 31 by the pickup roller 51, to the downstream side. The retard roller 13 has a rotational force in the arrow-c direction in FIG. 2A, which is weaker than that of the feed roller 12. If there is no sheet S in the nip portion of the separation conveyor roller pair 31, the feed roller 12 and the retard roller 13 abut against each other, and the retard roller 13 is driven to rotate in the direction opposite to the arrow-c direction in FIG. 2A by being driven by a frictional force generated between the feed roller 12 and the retard roller 13. Also, when one sheet S is fed to the nip portion of the separation conveyor roller pair 31, the retard roller 13 is driven to rotate in the direction opposite to the arrow-c direction by being driven by a frictional force generated between the sheet S and the retard roller 13. On the other hand, when two or more sheets S are fed to the nip portion of the separation conveyor roller pair 31, that is, when multi feed occurs, a frictional force generated between the sheets S is small, so the retard roller 13 rotates in the arrow-c direction. Consequently, the retard roller 13 pushes back the second and subsequent sheets S from the top in the nip portion in the direction of the lifter 61, and the feed roller 12 feeds only the uppermost sheet S in the arrow-b direction.

A connection conveyance path 32 is formed in that portion of the paper deck 3000, which is connected to the apparatus main body 900, and feeds the sheets S from the paper deck 3000 to the pre-registration roller pair 130 of the apparatus main body 900. A sensor 14 senses a sheet on the connection conveyance path 32.

The paper deck 3000 having the above arrangement or one of the sheet feeding cassettes 1001 to 1004 feeds the sheet S. The leading edge of the fed sheet S abuts against the nip portion of the pre-registration roller pair 130. The pre-registration roller pair 130 includes a pair of opposite rollers, and is arranged on the conveyance path of the sheets S so as to be rotatable in the direction of an arrow d in FIG. 2A. The sheet S which once abuts against the nip portion of the pre-registration roller pair 130 is conveyed into the apparatus main body 900 by the pre-registration roller pair 130 which rotates in synchronism with the feed timing.

A sheet surface sensor 50 is installed on the upstream side of the pickup roller 51. The sheet surface sensor 50 is arranged above the lifter 61, and senses the sheet S on the stacking member.

Figure 2B:
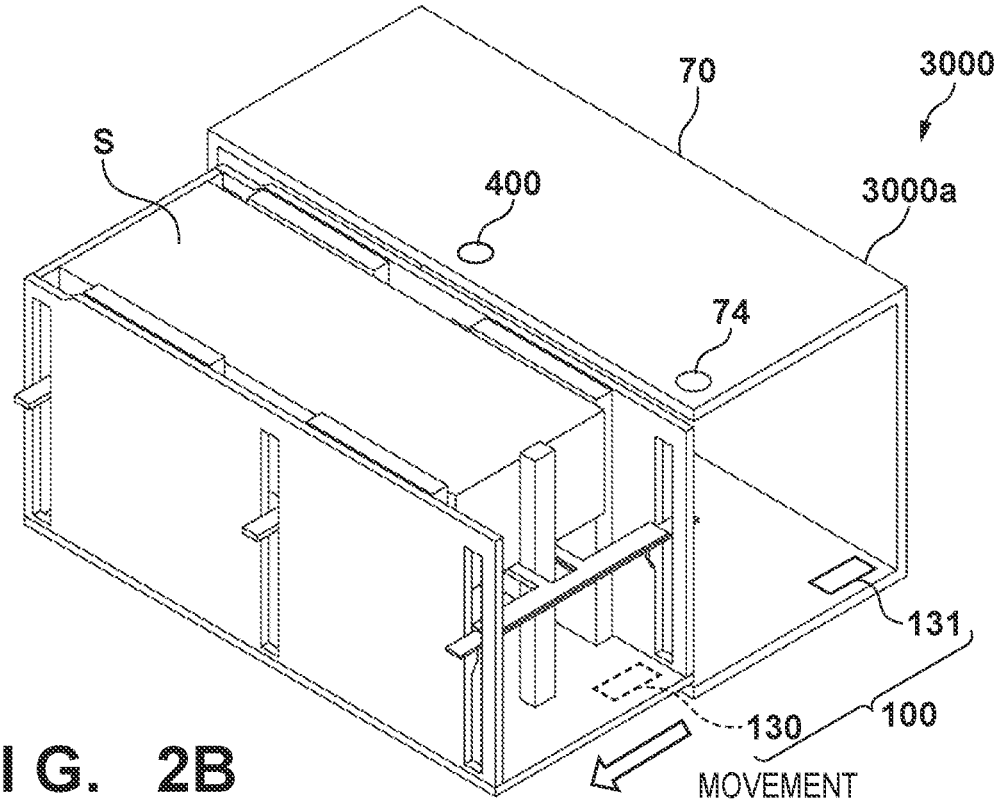
FIG. 2B is a view showing the arrangement of the paper deck, and showing a state in which a large-capacity deck storage is pulled out.

FIG. 2B is a view showing a state in which the large-capacity deck storage 62 is pulled out to the front side from the paper deck 3000. The user pulls out the large-capacity deck storage 62 when, for example, replenishing sheets or removing sheets remaining in the lifter 61. The paper deck 3000 includes a sheet feeding apparatus housing 70, an LED 400 for notifying the state of the lifter 61, and an opening/closing instruction button 74 for accepting an instruction to pull out the large-capacity deck storage 62. The large-capacity deck storage 62 can be pulled out when the user presses the opening/closing instruction button 74. The paper deck 3000 further includes a rail-type retracting mechanism 100 capable of reducing an operation power when the user closes the large-capacity deck storage 62. The rail-type retracting mechanism 100 includes a storage-side member 130 and a housing-side member 131 shown in FIG. 2B. The storage-side member 130 is formed on a surface which is the bottom surface of the large-capacity deck storage 62 and which faces the sheet feeding apparatus housing 70 in the fixing position. For example, the storage-side member 130 is formed on the rear surface in a position indicated by the broken lines in FIG. 2B. The housing-side member 131 is formed on a surface which is the bottom surface of the sheet feeding apparatus housing 70 and which faces the large-capacity deck storage 62, and in a position where the housing-side member 131 overlaps the storage-side member 130 in the fixing position.

Figure 3A:
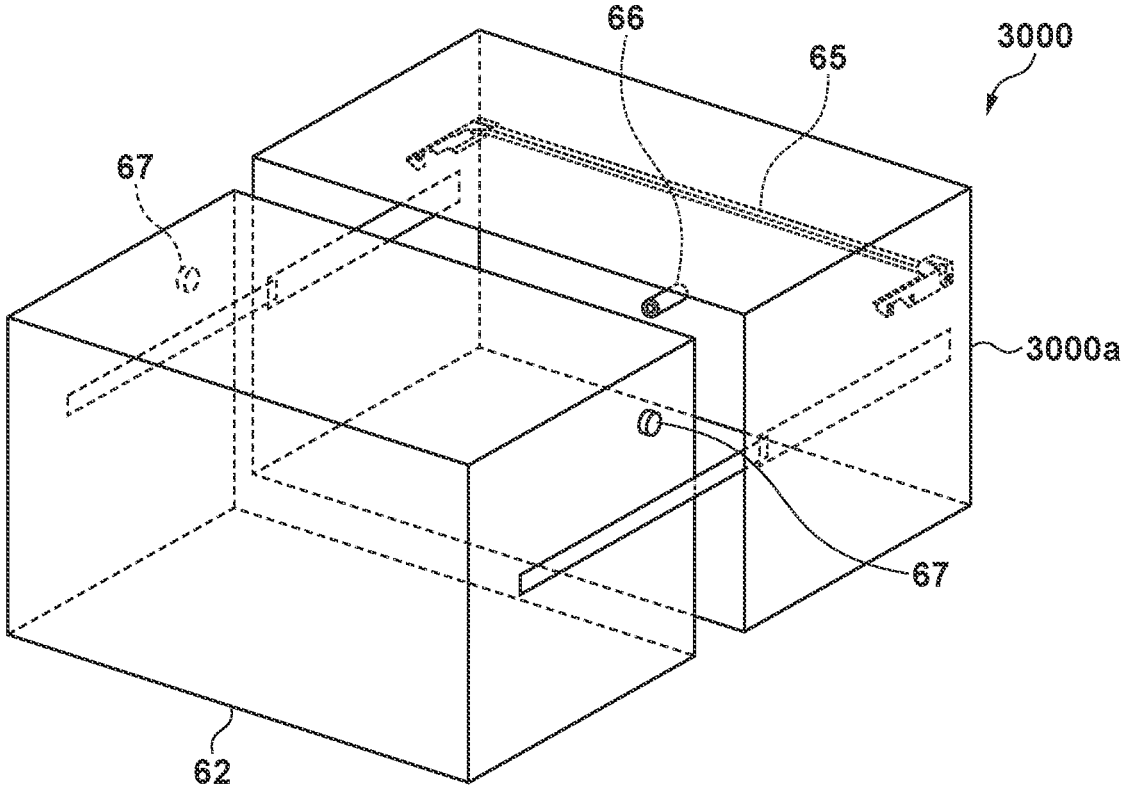
FIG. 3A is a schematic view showing a structure of locking the large-capacity deck storage and a sheet feeding apparatus housing.
Figure 3B:
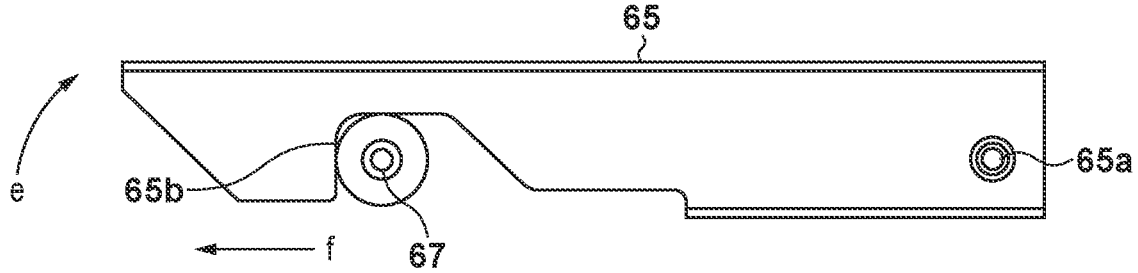
FIG. 3B is a view showing a state in which a locking member is locked by a projection formed on the large-capacity deck storage.

FIG. 3A is a schematic view of locking members 65 to be locked to the sheet feeding apparatus housing 70 when the large-capacity deck storage 62 is closed. FIG. 3B is a view showing a state (locked state) in which the locking members 65 are locked by columnar projections 67 formed on the large-capacity deck storage 62. The large-capacity deck storage 62 is fixed in a fixing position by a fixing unit including the locking members 65 and the projections 67. In this embodiment, the locking members 65 are formed on the two side surfaces of the sheet feeding apparatus housing 70 so that the locking members 65 can rotate upward from the horizontal direction around a rotation center 65*a*. When the projections 67 are locked by locking surfaces 65*b* of the locking members 65, the movement of the large-capacity deck storage 62 in the opening direction is regulated.

Figure 3C:
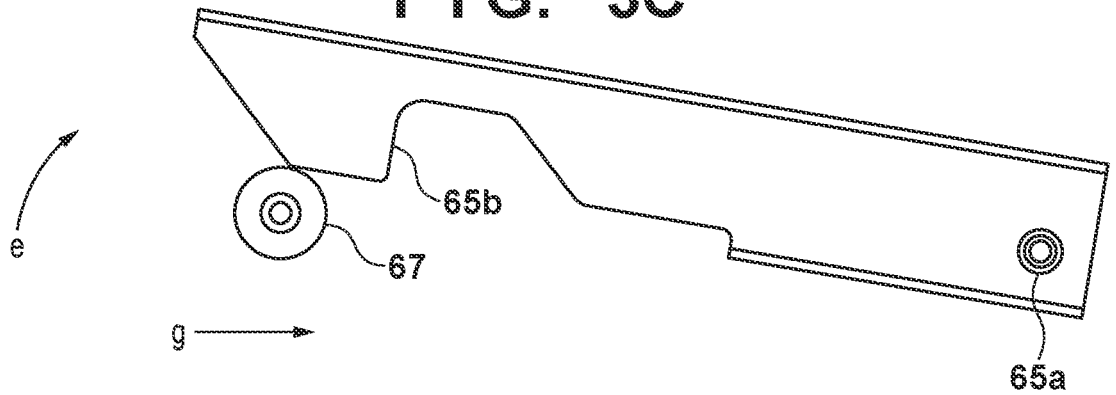
FIG. 3C is a view showing the actions of the locking member and the projection when closing the large-capacity deck storage.

FIG. 3C is a view showing the actions of the locking member 65 and the projection 67 when the large-capacity deck storage 62 is closed. When the user starts the operation of closing the large-capacity deck storage 62, the projection 67 of the large-capacity deck storage 62 moves in the direction of an arrow gin FIG. 3C with respect to the locking member 65 of the sheet feeding apparatus housing 70. When the projection 67 reaches the position of the locking member 65 by the operation of closing the large-capacity deck storage 62 by the user, the projection 67 pushes up the locking member 65, and the locking member 65 rotates in the direction of an arrow e in FIG. 3B around the rotation center 65*a*. When the large-capacity deck storage 62 is further pushed inside to the fixing position, the locked state shown in FIG. 3B is obtained. When the large-capacity deck storage 62 is pushed inside to the fixing position, the large-capacity deck storage 62 is biased in the direction of an arrow fin FIG. 3B by a storage pushing spring 66. Since, however, the projection 67 is locked on the locking surface 65*b*, the large-capacity deck storage 62 is held in the locking position. Note that the sheet feeding apparatus housing 70 may also include, for example, a mechanical stopper (not shown) for absorbing an impact when the large-capacity deck storage 62 collides against the sheet feeding apparatus housing 70.

When the opening/closing instruction button 74 is pressed in a state in which the large-capacity deck storage 62 is in the fixing position, an electromagnetic solenoid (not shown) operates, and the locking member 65 rotates in the arrow-e direction in FIG. 3B. Consequently, the projection 67 is unlocked from the locking member 65, and the large-capacity deck storage 62 is pushed out in the opening direction by the force of the storage pushing spring 66, to such an extent that the user can put his or her fingers on the upper portion of the large-capacity deck storage 62.

<Arrangements of Side Regulating Members and Side Regulating Member Support Mechanism>

Next, the arrangements of the side regulating members 80 and 83 will be explained. As shown in FIG. 2A, the sheet feeding apparatus 30 includes the two pairs of side regulating members 80 and 83. The side regulating members 80 and 83 are members for regulating the end positions in the widthwise direction (the arrow-h direction in FIG. 2A) perpendicular to the feeding direction (the arrow-b direction in FIG. 2A) of the sheets S stacked on the lifter 61, and can move in the widthwise direction.

The two pairs of side regulating members 80 and 83 are so configured as to be able to move in the widthwise direction to all sheet side widths supported by the specifications, and guide the sheets S on the lifter 61. That is, the side regulating members 80 and 83 abut against the two end portions of the stacked sheets S by moving in the widthwise direction, thereby regulating the two side positions of the sheets S. Also, a front-end regulating portion 86 regulates the front end portion of the sheet S on the lifter 61. Furthermore, a rear-end regulating member 87 regulates the rear end portion of the sheet S on the lifter 61. The rear-end regulating member 87 is so supported as to be movable in the sheet feeding direction (the arrow-b direction), and the position of the rear-end regulating member 87 can be adjusted, in accordance with the size of the sheet S, along a positioning elongated hole 61*c* formed in the central portion of the lifter 61.

Figure 4A:
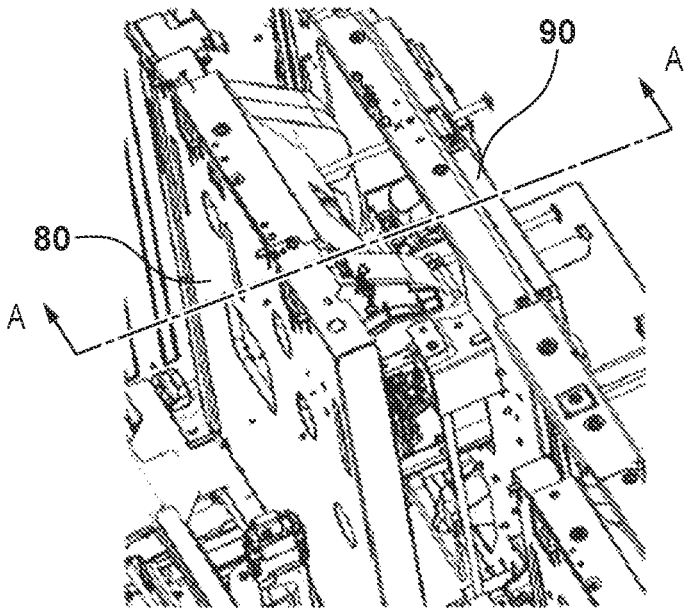
FIG. 4A is a schematic view of a side regulating member and a side regulating member support mechanism.
Figure 4B:
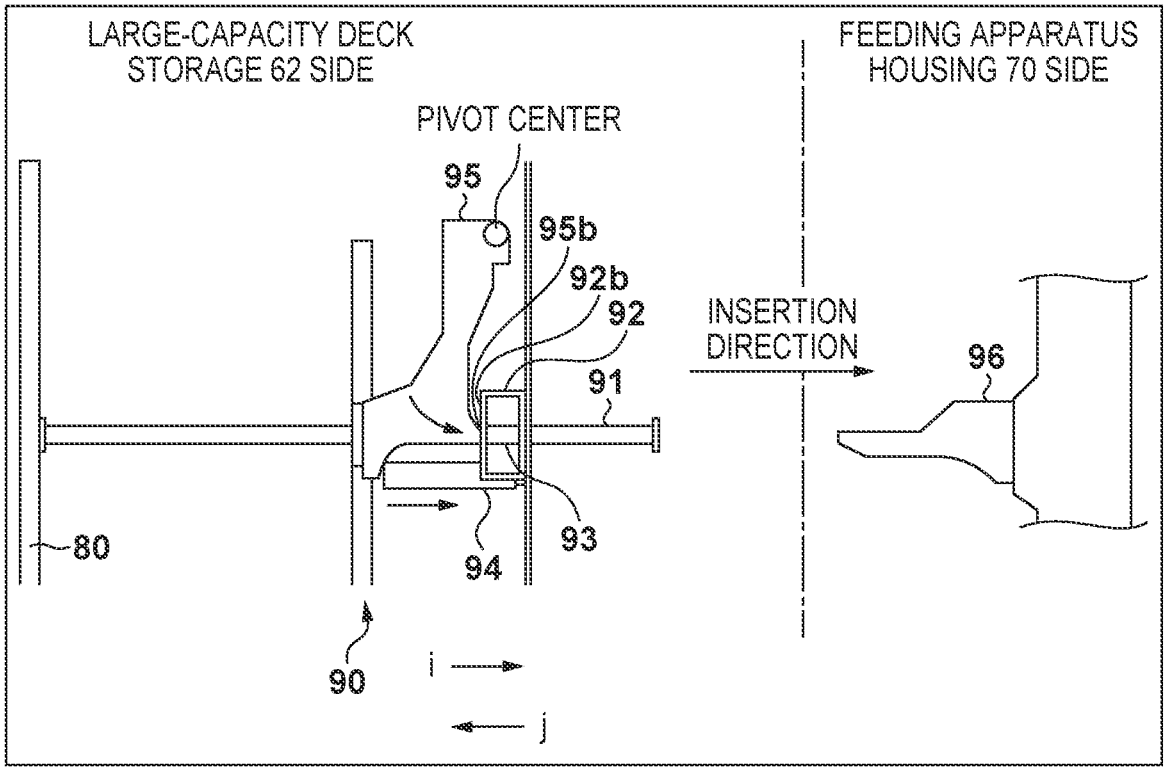
FIG. 4B is a schematic sectional view taken along a line A-A in FIG. 4A.

FIG. 4A is a schematic view of the side regulating member 80 and the side regulating member support mechanism 90 (a repulsive unit). FIG. 4B is a schematic sectional view taken along a line A-A in FIG. 4A. The side regulating member support mechanism 90 is a mechanism which prevents the side regulating members 80 and 83 on the back side from being bent by the force of inertia of a large amount of stacked sheets S, when the large-capacity deck storage 62 is forcibly closed. The side regulating member support mechanism 90 includes a lock shaft 91 which extends in the moving direction of the large-capacity deck storage 62 from the side regulating members 80 and 83, and receives the inertia force of the sheets. The side regulating member support mechanism 90 also includes, on the side of the large-capacity deck storage 62, a lock plate 92, a lock plate biasing spring 93, an unlocking spring 94, and a coupling member 95. The lock plate 92 regulates the movement of the lock shaft 91 when the large-capacity deck storage 62 is closed to a predetermined position. The lock plate biasing spring 93 couples with the lock plate 92, and biases the lock plate 92 in a direction to regulate the movement of the lock shaft 91. The unlocking spring 94 couples with the coupling member 95, and biases the coupling member 95 in a direction to regulate the movement of the lock plate 92 by a force larger than that of the lock plate biasing spring 93. The side regulating member support mechanism 90 further includes, on the side of the feeding apparatus housing 70, a projecting member 96 which extends from the feeding apparatus housing 70 to the large-capacity deck storage 62 and abuts against the coupling member 95 when the large-capacity deck storage 62 is closed to a predetermined position.

<Arrangement of Rail-Type Retracting Mechanism (Biasing Unit)>

Figure 5:
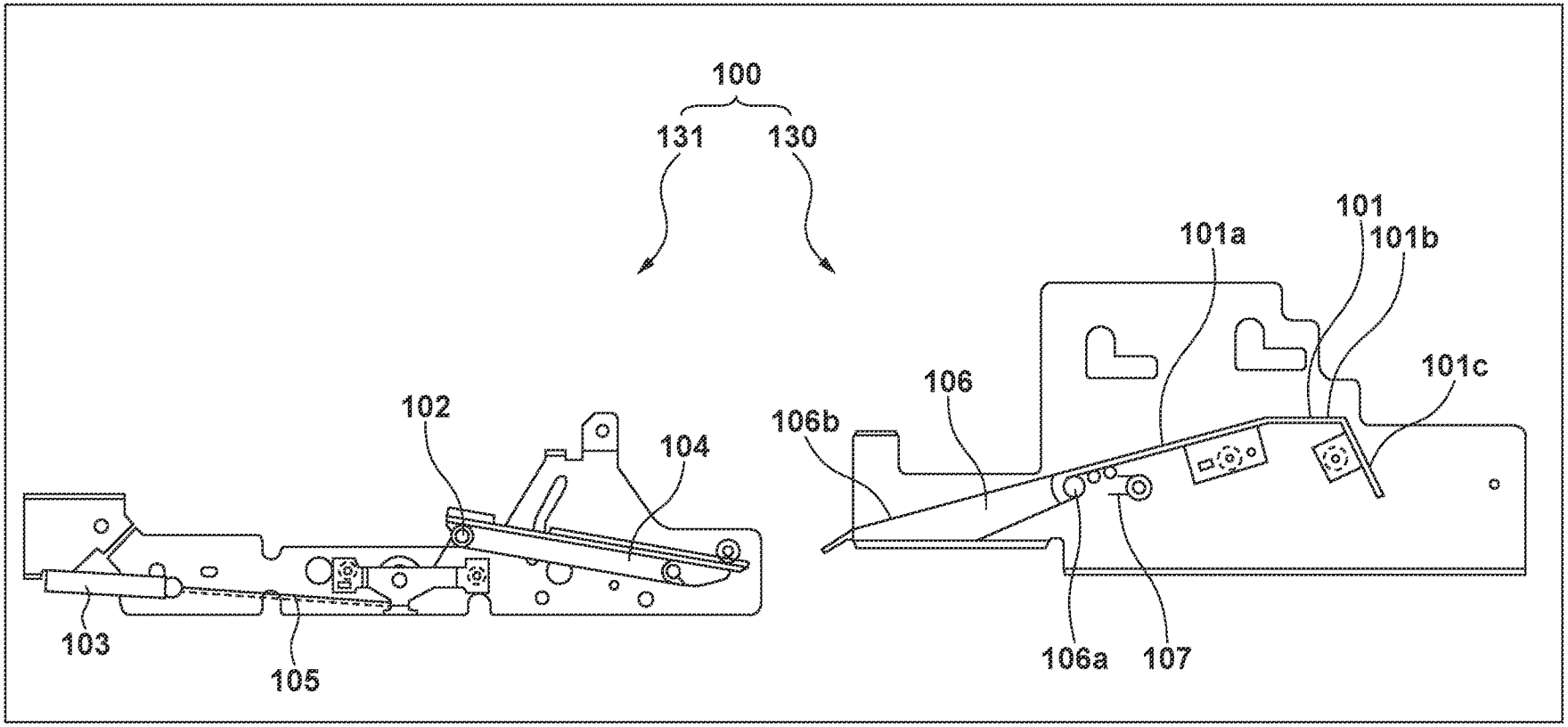
FIG. 5 is a schematic view of a rail-type retracting mechanism.

The arrangement of the rail-type retracting mechanism 100 (a biasing unit) using a rail of the large-capacity deck storage 62 will be explained below. The rail-type retracting mechanism 100 is a biasing mechanism which biases the large-capacity deck storage 62 in a direction (insertion direction) to insert the large-capacity deck storage 62, when the user inserts and fixes the large-capacity deck storage 62 by a sliding operation. FIG. 5 is a schematic view of the rail-type retracting mechanism 100. The rail-type retracting mechanism 100 includes the storage-side member 130 and the housing-side member 131. The storage-side member 130 is formed on a surface which is the bottom surface of the large-capacity deck storage 62 and which faces the sheet feed apparatus housing 70 in the fixing position (for example, in a position indicated by the broken lines in FIG. 2B). The housing-side member 131 is formed on a surface which is the bottom surface of the sheet feeding apparatus housing 70 and which faces the large-capacity deck storage 62, and in a position where the housing-side member 131 overlaps the storage-side member 130 in the fixing position.

The storage-side member 130 includes a rail 101, a variable guide 106, and a variable guide spring 107. The housing-side member 131 includes a roller 102, a retracting spring 103, an arm 104, and a wire 105. The rail 101 includes a first inclined surface 101*a*, a horizontal surface 101*b*, and a second inclined surface 101*c*, and the roller 102 having a columnar shape can rotate on each surface. The roller 102 is rotatably held by the arm 104 which can pivot. The arm 104 is coupled with the retracting spring 103 for generating a retracting force via the wire 105. The variable guide 106 has a roller passing surface 106*b* on an extension line of the first inclined surface 101*a* of the rail 101, and is pivotally held around a pivotal center 106*a*. The variable guide spring 107 biases the variable guide 106 downward on the drawing surface.

In this embodiment, the rail-type retracting mechanisms 100 are installed near the two end portions of the large-capacity deck storage 62 and the sheet feeding apparatus housing 70 in the feeding direction. This embodiment uses the two rail-type retracting mechanisms 100, but the number of the mechanisms is not limited and may also be one or three or more. In this embodiment, the two rail-type retracting mechanisms 100 are arranged in the same position (the same phase) in the opening/closing direction. The larger the number of the rail-type retracting mechanisms 100, the larger the retracting force during the closing operation. Also, the positions of the rail-type retracting mechanisms 100 need only have a positional relationship by which the storage-side member 130 and the housing-side member 131 act on each other, and are not limited in both the b direction and the h direction in FIG. 2A. Furthermore, it is also possible to form the storage-side member 130 in the sheet feeding apparatus housing 70, and form the housing-side member 131 in the large-capacity deck storage 62.

<Action of Side Regulating Member Support Mechanism (Repulsive Unit)>

Figure 6A:
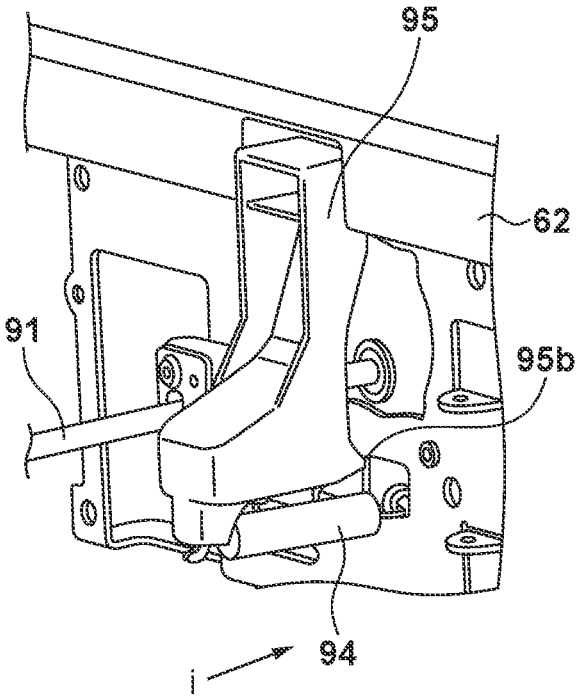
FIG. 6A is a view showing the side regulating member support mechanism when the large-capacity deck storage is open.
Figure 6B:
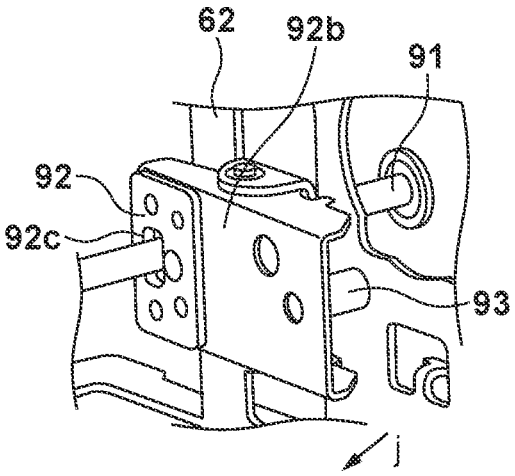
FIG. 6B is an enlarged view of a lock plate and a lock shaft shown in FIG. 6A.
Figure 6C:
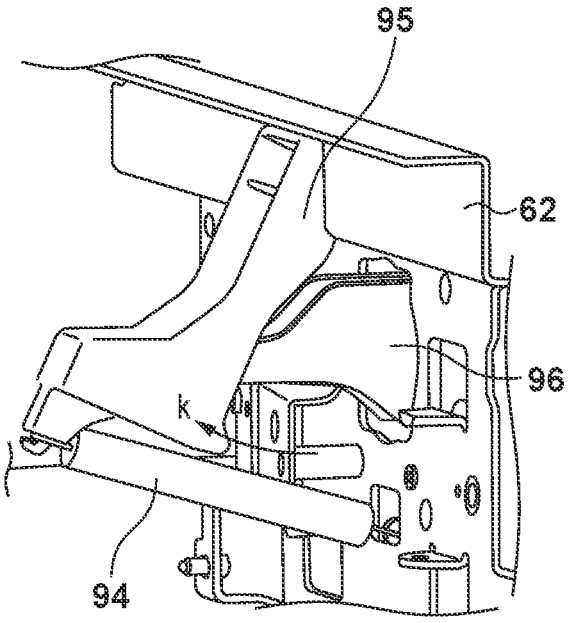
FIG. 6C is a view showing the side regulating member support mechanism when the large-capacity deck storage is closed.
Figure 6D:
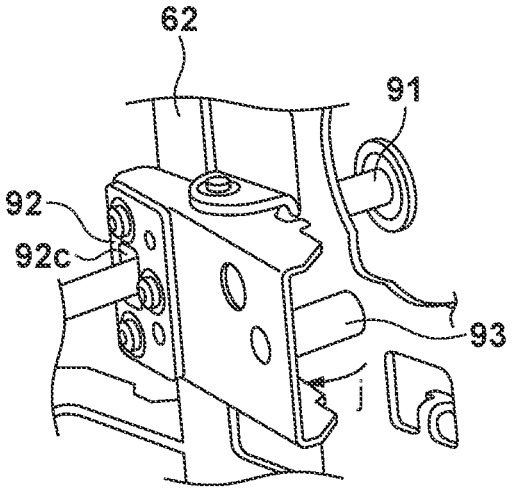
FIG. 6D is an enlarged view of a lock plate and a lock shaft shown in FIG. 6C.

The action of the side regulating member support mechanism 90 will be explained below. FIGS. 6A to 6D are schematic views when the side regulating member support mechanism 90 is acting. FIG. 6A is a side regulating member support mechanism 90 in a state in which the large-capacity deck storage 62 is open. FIG. 6B is an enlarged view of the lock plate 92 and the lock shaft 91 in the state shown in FIG. 6A. FIG. 6C is a view showing the side regulating member support mechanism 90 in a state in which the large-capacity deck storage 62 is closed. FIG. 6D is an enlarged view of the lock plate 92 and the lock shaft 91 in the state shown in FIG. 6C.

In the state in which the large-capacity deck storage 62 is open, that is, in the state shown in FIGS. 6A and 6B, an abutting portion 95*b* of the coupling member 95 abuts against an abutting surface 92*b* of the lock plate 92. In this state, the unlocking spring 94 biases the coupling member 95 in the direction of an arrow i in FIG. 6A. On the other hand, the lock plate biasing spring 93 biases the lock plate 92 in the direction of an arrow j in FIG. 6B. The biasing force of the unlocking spring 94 is larger than that of the lock plate biasing spring 93. When the large-capacity deck storage 62 is open, therefore, the lock plate 92 is held by being pushed against the wall of the large-capacity deck storage 62 by the coupling member 95. In this state, the lock shaft 91 can freely move in a hole 92*c* formed in the lock plate 92.

When the operation of inserting the large-capacity deck storage 62 is performed and the large-capacity deck storage 62 reaches a predetermined position before the locking position, as shown in FIG. 6C, the projecting member 96 formed on the sheet feeding apparatus housing 70 pushes the coupling member 95 in the direction of an arrow k in FIG. 6C. Since there is no more pushing force by the coupling member 95, the lock plate 92 is pivoted in the arrow-j direction by the lock plate biasing spring 93. When the lock plate biasing spring 93 pivots, the edge of the hole 92*c* is pushed against the lock shaft 91, and the motion of the lock shaft 91 is regulated. Since the lock shaft 91 is fixed, the motions of the side regulating members 80 and 83 to which the lock shaft 91 is connected can be fixed. Even if the inertia force of the sheets S acts on the side regulating members 80 and 83 in the state in which the lock shaft 91 is fixed, the lock shaft 91 can receive the inertia force of the sheets S, so bending of the side regulating members 80 and 83 on the back side can be prevented.

In the abovementioned action, a repulsive force starts occurring at a position at which the projecting member 96 abuts against the coupling member 95 (a repulsion start position). The user performs the closing operation against the repulsive force of the unlocking spring 94 in a zone, namely, a repulsive zone, in which the projecting member 96 pushes the coupling member 95. Therefore, the user receives a large repulsive force right before the large-capacity deck storage 62 is fixed. That is, the side regulating member support mechanism 90 is a repelling mechanism which repels the force in the insertion direction, when the user inserts the large-capacity deck storage 62 by the sliding operation. In this embodiment, therefore, the rail-type retracting mechanism is applied to reduce the repulsive force which the user receives right before the large-capacity deck storage 62 is fixed. The action of the retracting mechanism will be explained below.

<Action of Rail-Type Retracting Mechanism>

Figure 7:
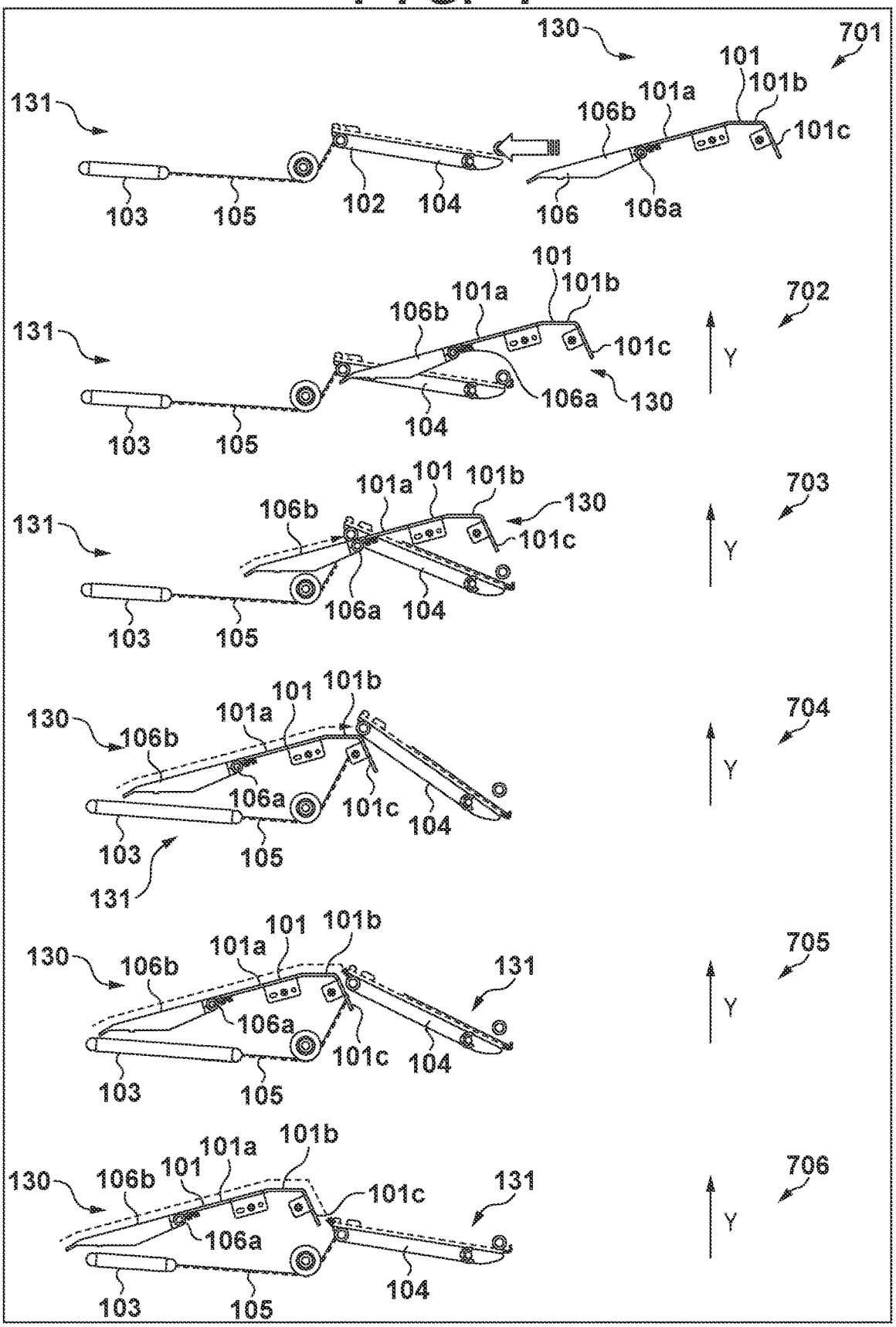
FIG. 7 is a view showing the action of the rail-type retracting mechanism when inserting the large-capacity deck storage.
Figure 8:
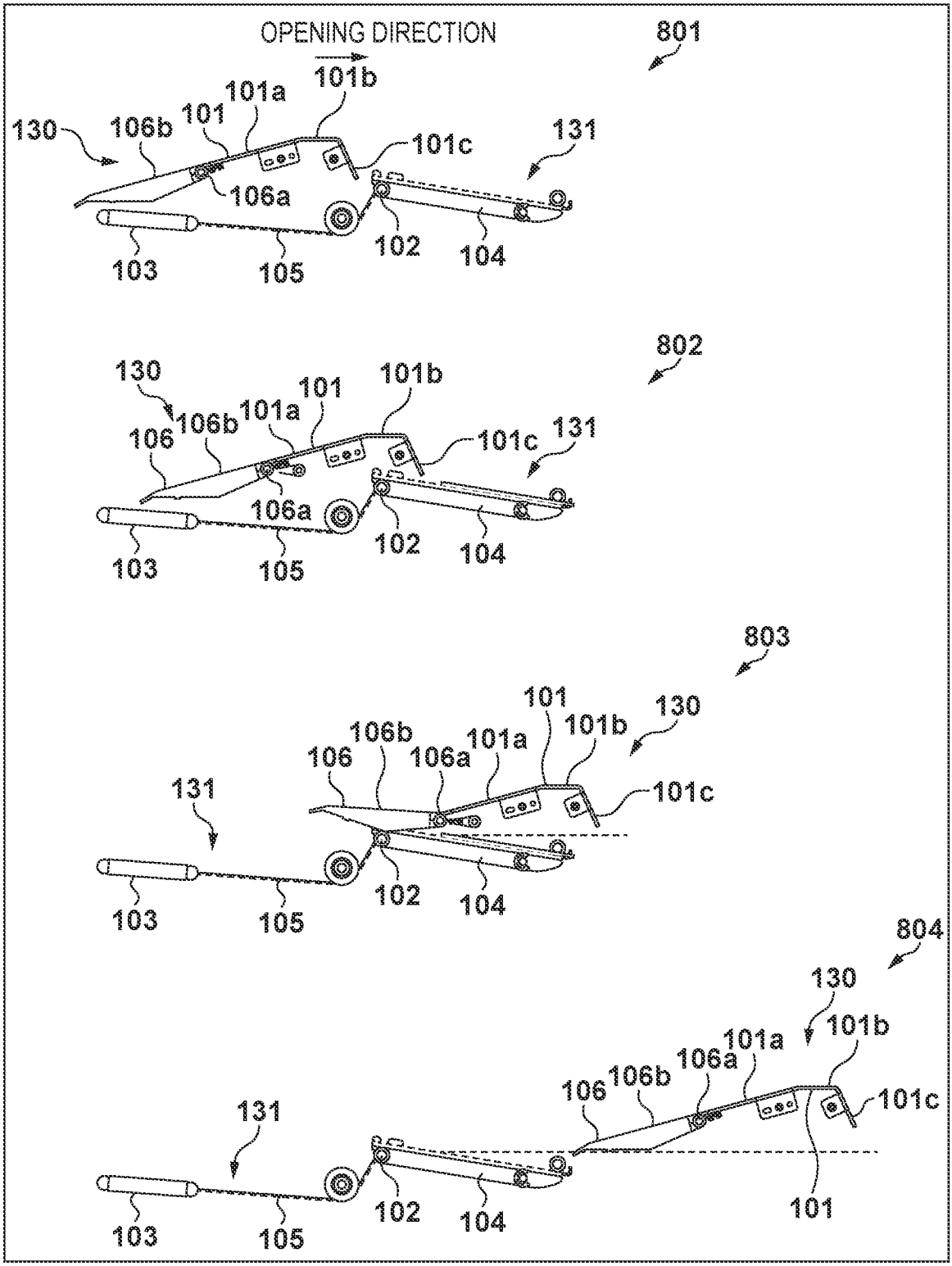
FIG. 8 is a view showing the action of the rail-type retracting mechanism when opening the large-capacity deck storage.

FIG. 7 is a view showing the operation of the rail-type retracting mechanism 100 when closing the storage. FIG. 8 is a view showing the operation of the rail-type retracting mechanism 100 when opening the storage.

When the large-capacity deck storage 62 is open, the storage-side member 130 and the housing-side member 131 are spaced apart in the opening/closing direction as shown in a state 701. When the large-capacity deck storage 62 is closed right before the fixing position, the roller 102 climbs the roller passing surface 106*b* of the variable guide 106 as shown in a state 702. When the large-capacity deck storage 62 is further closed, the roller 102 climbs the first inclined surface 101*a* of the rail 101 as shown in a state 703. While the roller 102 is climbing the roller passing surface 106*b* and the first inclined surface 101*a*, the displacement of the roller 102 in the Y direction increases, so the retracting spring 103 is extended via the wire 105, and elastic energy is accumulated in the retracting spring 103. That is, a zone indicated by the states 702 and 703 is an extension zone (energy accumulation zone) of the retracting spring 103. When the large-capacity deck storage 62 is further closed, the roller 102 moves on the horizontal surface 101*b* as shown in a state 704. In this state, energy is neither accumulated nor released because the roller 102 does not move in the Y direction. In this embodiment, the roller 102 passes through the extension zone and moves to the horizontal surface before the side regulating member support mechanism 90 generates the above-described repulsive force. Also, the timing at which the roller 102 passes through the extension zone and moves to the horizontal surface need only be at least before the repulsive force of the side regulating member support mechanism 90 becomes maximum. By thus setting the timing at which the roller 102 passes through the extension zone and moves to the horizontal surface, it is possible to minimize the zone in which both the repulsive force of the side regulating member support mechanism 90 and the force for extending the retracting spring 103 are necessary. Accordingly, the necessary operation power of the user can be decreased. As shown in a state 705, when the roller 102 passes through the horizontal surface 101*b* and approaches the second inclined surface 101*c*, the accumulated elastic energy biases the roller 102 in a direction to go down the second inclined surface 101*c*. While the roller 102 is going down the second inclined surface 101*c*, the released elastic energy pushes the roller 102 against the second inclined surface 101*c* (a biasing zone). That is, the second inclined surface 101*c* receives the force by which the roller 102 pushes the second inclined surface 101*c* in the closing direction. In the state 705, therefore, the biasing operation of the rail-type retracting mechanism 100 biases the large-capacity deck storage 62 in the closing direction, and this reduces the repulsive force which the user feels. A maximum value of the repulsive force which the user feels can be decreased by matching the zone in which the large-capacity deck storage 62 is biased in the closing direction with the zone in which the repulsive force generated by the side regulating member support mechanism 90 is large. As shown in a state 706, the accumulated elastic energy is released when the roller 102 has completely gone down the inclined surface, and the roller 102 stops in a position deviated from the rail 101. In this state, the large-capacity deck storage 62 reaches the fixing position. That is, when the sliding operation by the user is over and the large-capacity deck storage 62 is fixed in the fixing position, the biasing operation of the rail-type retracting mechanism 100 is complete, and the elastic energy is entirely released.

When opening the large-capacity deck storage 62, as shown in a state 802, the roller 102 passes through the side (the lower side in the direction of the drawing surface) opposite to the surface of the rail 101 on which the roller 102 goes up and down. As shown in a state 803, when the roller 102 approaches the variable guide 106, the roller 102 pushes up the variable guide 106 and passes through it. When the roller 102 thus pushes up the variable guide 106 and passes through it, the state is indicated by a state 804, and returns to the state 701.

<Change in Operation Power Required for User when Inserting Large-Capacity Deck Storage>

Figure 9:
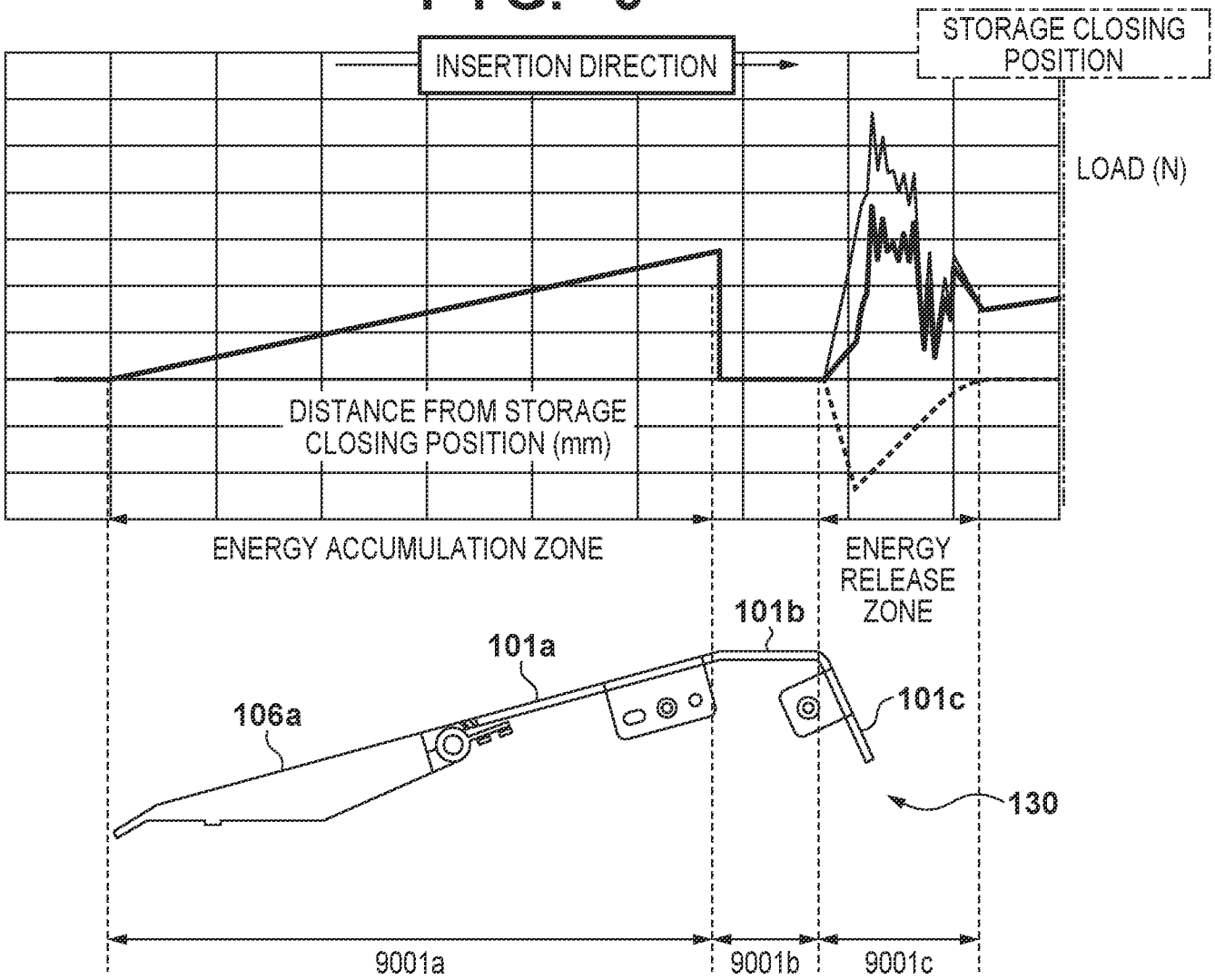
FIG. 9 is a view showing changes in, for example, operation power necessary for the user when inserting the large-capacity deck storage.

FIG. 9 is a view showing a change in operation power (the thick solid line) required for the user, a change in repulsive force (the thin solid line) by the repelling operation of the side regulating member support mechanism 90, and a change in load (the broken line) by the retracting spring 103 of the rail-type retracting mechanism 100 when inserting the large-capacity deck storage 62. FIG. 9 also shows the position of the roller 102 on the variable guide 106 and the rail 101 in association with the load by the retracting spring 103 in that position. In FIG. 9, the ordinate indicates the load, and the abscissa indicates the distance from the storage closing position.

In a zone (a zone 9001*a* in FIG. 9) in which the roller 102 climbs the roller passing surface 106*b* of the variable guide 106 and the first inclined surface 101*a* of the rail 101, the retracting spring 103 is extended and elastic energy is accumulated. On the other hand, the operation power required for the user increases. In a zone (a zone 9001*b* in FIG. 9) in which the roller 102 moves on the horizontal surface 101*b*, the retracting spring 103 is neither extended nor contracted, so the elastic energy is neither accumulated nor released. In a zone (a zone 9001*c* in FIG. 9) in which the roller 102 goes down the second inclined surface 101*c*, the difference between the repulsive force generated by the side regulating member support mechanism 90 and the biasing force by which the retracting spring 103 performs biasing in the closing direction is the operation power required for the user. That is, the operation power required for the user is reduced by the amount of biasing force by which the retracting spring 103 performs biasing in the closing direction. In a zone after the elastic energy of the retracting spring 103 is released, the sum of the spring force of the unlocking spring 94 and the spring force of the storage pushing spring 66 when the projecting member 96 pushes the coupling member 95 is the operation power necessary for the user.

As described above, when closing the large-capacity deck storage 62, the biasing operation of the rail-type retracting mechanism 100 biases the large-capacity deck storage 62 in the insertion direction, so the operation load on the user can be reduced. The timing of this biasing operation of the rail-type retracting mechanism 100 partially overlaps the timing of the repelling operation of the side regulating member support mechanism 90. In other words, the biasing zone in which the rail-type retracting mechanism 100 generates the biasing force and the repulsive zone in which the side regulating member support mechanism 90 generates the repulsive force partially overlap each other in the insertion direction.

When the large-capacity deck storage 62 is in the fixing position, the biasing operation by the rail-type retracting mechanism 100 is complete. That is, the elastic energy of the retracting spring 103 is entirely released before the large-capacity deck storage 62 collides against the sheet feeding apparatus housing 70. When compared to a case in which the elastic energy remains, therefore, it is possible to suppress the force when the large-capacity deck storage 62 and the sheet feeding apparatus housing 70 collide. This makes it possible to reduce the load to be applied to a member such as a mechanical stopper which receives the collision force, and prevent an increase in load to be applied to the apparatus by the operation of closing the paper deck 3000.

In this embodiment, a case in which the timing at which the rail-type retracting mechanism 100 starts generating the biasing force and the timing at which the side regulating member support mechanism 90 starts generating the repulsive force are the same (the same position) in the zone 9001*c* of FIG. 9 is explained. When the timing at which the rail-type retracting mechanism 100 starts generating the biasing force is the same as or earlier than the timing at which the side regulating member support mechanism 90 starts generating the repulsive force, the operation power necessary for the user to insert and fix the large-capacity deck storage 62 is reduced.

Modifications of Embodiment

Modifications of the embodiment will be explained below. In a sheet feeding apparatus including a plurality of rail-type retracting mechanisms 100, the first inclined surfaces 101*a* of the storage-side members 130 may also be shifted from each other in the opening/closing directions.

Figure 10:
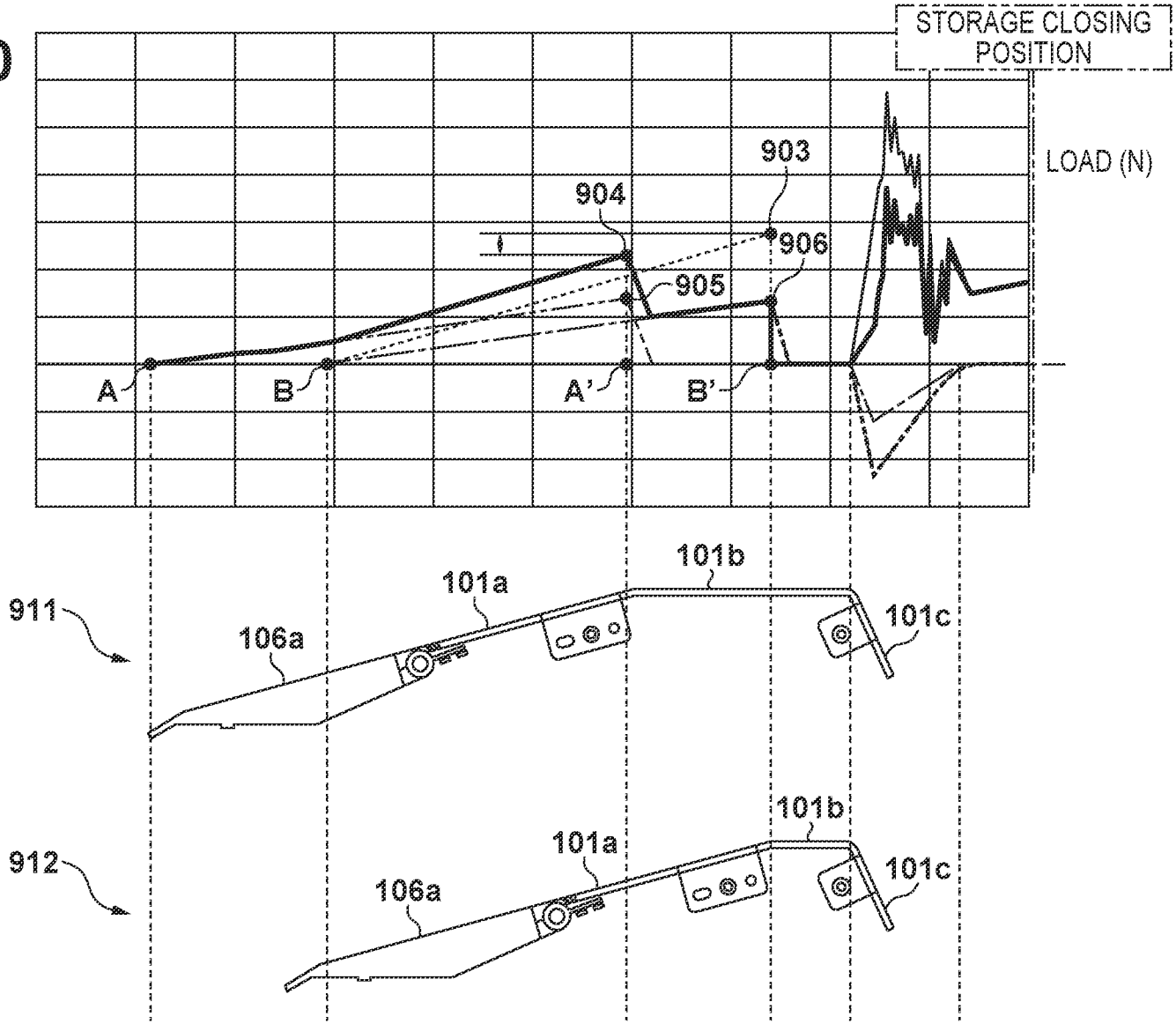
FIG. 10 is a view showing changes in, for example, operation power necessary for the user when inserting the large-capacity deck storage, in a case in which a plurality of rail-type retracting mechanisms are arranged as they are shifted from each other.

FIG. 10 is a view showing changes in, for example, operation power necessary for the user when the first inclined surfaces 101*a* of the storage-side members 130 of rail-type retracting mechanisms 911 and 912 are shifted from each other in the opening/closing directions. The thick solid line indicates the operation power required for the user, the thin solid line indicates the repulsive force generated by the repelling operation of the side regulating member support mechanism 90, and the broken line indicates the sum of the loads of the retracting springs 103 when the two rail-type retracting mechanisms 100 are arranged in the same position in the opening/closing directions (in the case of the same phase). Also, the long and two short dashed line indicates the load of the retracting spring 103 of the rail-type retracting mechanism 911, the long and short dashed line indicates the load of the retracting spring 103 of the rail-type retracting mechanism 912, and the dotted line indicates the sum of the loads of the retracting springs 103 of the rail-type retracting mechanisms 911 and 912. Furthermore, a peak point 903 indicates the peak of the sum of the loads of the two retracting springs 103 when the two rail-type retracting mechanisms 100 are in the same phase. On the other hand, a peak point 904 indicates the peak of the sum of the loads of the two retracting springs 103 of the rail-type retracting mechanisms 911 and 912.

FIG. 10 shows a state in which the energy accumulation zone of the rail-type retracting mechanism 911 is formed in a position AA', and the energy accumulation zone of the rail-type retracting mechanism 912 is formed in a position BB' in association with each other. In FIG. 10, the ordinate indicates the load, and the abscissa indicates the distance from the storage closing position. FIG. 10 also shows fluctuations in operation power and retracting spring load, with respect to the distance from the storage closed position, when the roller 102 moves on the storage-side member 130, for each of the plurality of rail-type retracting mechanisms 911 and 912. The plurality of rail-type retracting mechanisms 911 and 912 are so arranged that the positions of the energy accumulation zones (the roller passing surfaces 106*b* and the first inclined surfaces 101*a*) are shifted from each other.

In the operation by which the user inserts the large-capacity deck storage 62, a peak point 905 of the load of the retracting spring 103 of the rail-type retracting mechanism 911 is reached before a peak point 906 of the load of the retracting spring 103 of the rail-type retracting mechanism 912. In the rail-type retracting mechanism 911, the roller 102 passes on the horizontal surface 101*b* after the peak point 905, so the retracting spring 103 generates no load. After that, the peak point 906 of the rail-type retracting mechanism 912 is reached in a state in which the retracting spring 103 of the rail-type retracting mechanism 911 is generating no load. That is, the timings of the peak points 905 and 906 are shifted. In an arrangement like this, the peak of the load of the retracting spring 103 can be decreased from the peak point 903 to the peak point 904 compared to a case in which the plurality of rail-type retracting mechanisms 911 and 912 are arranged in the same position (the same phase) in the opening/closing directions. Accordingly, it is possible to decrease the peak of the operation power required for the user in the energy accumulation zone.

Also, in the plurality of rail-type retracting mechanisms 911 and 912, the positions of the energy accumulation zones are shifted from each other in the opening/closing directions, but the lengths of the horizontal surfaces 101*b* are so set that the positions of the energy release zones (the second inclined surfaces 101*c*) are the same. In the energy release zones, therefore, the repulsive force which the user feels can be reduced in the same manner as when the plurality of rail-type retracting mechanisms 911 and 912 are arranged in the same position in the opening/closing directions (as in the case of the same phase).

Instead of setting the energy release zones (the second inclined surfaces 101*c*) in the same position as described above, it is also possible to shift the positions of the energy release zones of the rail-type retracting mechanisms 911 and 912. In this arrangement, the retracting force can be obtained at a longer distance corresponding to the amount of shift.

In addition to the abovementioned arrangements, it is also possible to appropriately change the inclinations and distances of the roller passing surface 106*b*, the first inclined surface 101*a*, and the second inclined surface 101*c*, and the distance of the horizontal surface 101*b*. For example, the inclination of the first inclined surface 101*a* may also be decreased. This arrangement can make the change in user's operation power gentle. In addition, the energy release zone can be prolonged by decreasing the inclination of the second inclined surface 101*c*.

In either case, the elastic energy of the retracting spring 103 is entirely released before the large-capacity deck storage 62 collides against the sheet feeding apparatus housing 70. This makes it possible to suppress the force when the large-capacity deck storage 62 and the sheet feeding apparatus housing 70 collide, compared to a case in which the elastic energy remains.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-250028, filed Dec. 26, 2017, and Japanese Patent Application No. 2018-233639, filed Dec. 13, 2018, which are hereby incorporated by reference herein in their entirety.

What is claimed is:

1. A sheet feeding apparatus for feeding a sheet to an image forming apparatus, comprising:

a housing;

a storage unit which is accommodated inside the housing, includes a sheet stacking unit capable of stacking a plurality of sheets, and is movable in an insertion direction with respect to the housing;

a biasing unit configured to generate a biasing force of biasing the storage unit in the insertion direction, when the storage unit moves in the insertion direction;

a repulsive unit configured to generate a repulsive force of biasing the storage unit in a direction opposite to the insertion direction;

a fixing unit configured to fix the storage unit in a fixing position inside the housing, in a state in which the storage unit is receiving the repulsive force from the repulsive unit; and a feeding unit configured to feed the sheets stacked in the sheet stacking unit to the image forming apparatus, wherein the biasing unit starts generating the biasing force in a repulsion start position where the repulsive unit starts generating the repulsive force, or on an upstream side of the repulsion start position, with respect to the insertion direction, and stops generating the biasing force before the storage unit reaches the fixing position, and a biasing zone in which the biasing unit generates the biasing force and a repulsive zone in which the repulsive unit generates the repulsive force partially overlap each other with respect to the insertion direction.

2. The sheet feeding apparatus according to claim 1, wherein the biasing unit includes a spring, and generates the biasing force by contracting of the extended spring.

3. The sheet feeding apparatus according to claim 2, wherein the spring of the biasing unit extends by a movement of the storage unit in the insertion direction, and after this extension, generates the biasing force by contracting the extended spring when the storage unit moves in the insertion direction.

4. The sheet feeding apparatus according to claim 3, wherein the biasing unit completes the extension of the spring before the repulsive force generated by the repulsive unit becomes maximum.

5. The sheet feeding apparatus according to claim 4, wherein before the storage unit moving in the insertion direction is fixed in the fixing position by the fixing unit, the extended spring contracts to a length before the extension.

6. The sheet feeding apparatus according to claim 3, further comprising a plurality of biasing units of which positions where the extended springs start contracting are different in the insertion direction.

7. The sheet feeding apparatus according to claim 3, wherein the biasing unit includes a plurality of biasing units in which extension zones of the springs in the insertion direction are different.

8. The sheet feeding apparatus according to claim 3, wherein the spring of the biasing unit does not extend when the storage unit moves in the direction opposite to the insertion direction.

* * * * *